United States Patent [19]

Fruin et al.

[11] 4,245,526

[45] Jan. 20, 1981

[54] MINING MACHINE HAULAGE TRANSMISSION

[75] Inventors: Harry J. Fruin, Barnsley; Paul Greenhough, Cleckheaton, both of England

[73] Assignee: Dresser Europe S.A., Brussels, Belgium

[21] Appl. No.: 911,878

[22] Filed: Jun. 2, 1978

[30] Foreign Application Priority Data

Jun. 2, 1977 [GB] United Kingdom ..... 23521/77

[51] Int. Cl.[3] ..... B60K 41/18; F16D 71/00

[52] U.S. Cl. ..... 74/856; 192/4 C; 192/150

[58] Field of Search ..... 192/4 C, 150; 74/856, 74/857, 858, 859

[56] References Cited

U.S. PATENT DOCUMENTS

| | | | |
|---|---|---|---|
| 3,487,772 | 1/1970 | Kraft | 192/150 X |
| 3,625,328 | 12/1971 | Carli | 192/150 X |
| 3,684,067 | 8/1972 | Anderson | 192/150 X |
| 3,828,900 | 8/1974 | Anderson | 192/150 X |
| 4,010,679 | 3/1977 | Dybel | 192/150 X |

FOREIGN PATENT DOCUMENTS

| | | | |
|---|---|---|---|
| 2541838 | 3/1977 | Fed. Rep. of Germany | 192/150 |

*Primary Examiner*—James Kee Chi

*Attorney, Agent, or Firm*—Larson, Taylor and Hinds

[57] ABSTRACT

A mining machine haulage transmission includes an overload protection arrangement comprising a torque sensing device which monitors the torque transmitted and brings about decoupling of one or more clutches to disconnect the transmission output from its input, in the event that the transmitted torque exceeds a predetermined threshold.

In one preferred arrangement, the torque sensing device produces electrical output signals dependent upon the transmitted torque to control operation of the clutch or clutches. In an alternative arrangement or in addition, a source of motive power is connectible to operate the clutch or clutches and control means are provided, responsive to the torque sensing device, to control connection of the power source to the clutch or clutches so as to bring about decoupling in the event of a torque overload.

16 Claims, 6 Drawing Figures

MINING MACHINE HAULAGE TRANSMISSION

Figure 1:
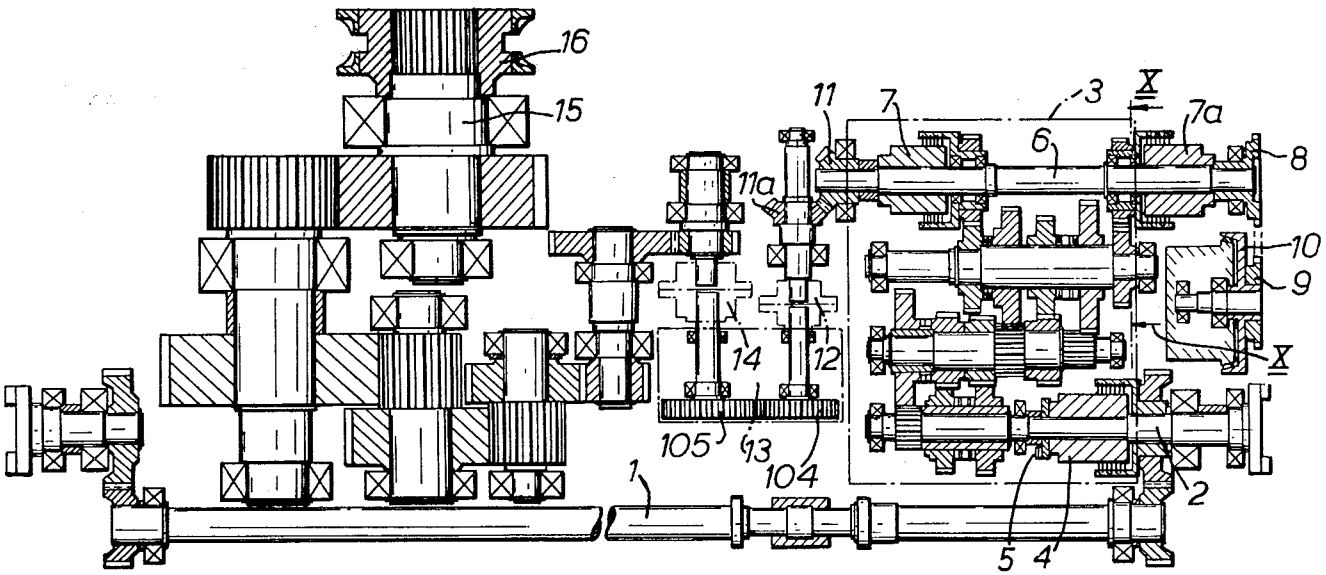

This invention relates to a mining machine haulage transmission.

According to the present invention from one aspect there is provided a mining machine haulage transmission including an overload protection arrangement comprising a torque sensing device which is arranged to monitor the torque transmitted, in use, by the transmission by producing electrical signals dependent upon the torque transmitted, decoupling means between the input and output of the transmission, and means responsive to the said electrical signals to decouple the decoupling means when the monitored torque reaches a predetermined threshold.

The signal responsive means may comprise drive means connectible to operate the decoupling means, and control means responsive to the said electrical signals to control connection of the drive means to the decoupling means.

According to the invention from another aspect, there is provided a mining machine haulage transmission including an overload protection arrangement comprising a torque sensing device which is arranged to monitor the torque transmitted, in use, by the transmission, decoupling means between the input and output of the transmission, drive means connectible to operate the decoupling means, and control means responsive to the torque sensing device to control connection of the drive means to the decoupling means to bring about decoupling of the decoupling means when the monitored transmitted torque reaches a predetermined threshold.

In haulage tranmissions having drive means and control means as aforesaid, the decoupling means can comprise at least one hydraulically operated clutch, the drive means comprising a hydraulic pump arranged to be driven by the transmission input and the control means comprising a hydraulic control valve.

In one preferred arrangement, the torque sensing device includes a compression load cell arranged so that, for a given input voltage, it produces, in use, electrical output signals of which the magnitude is linearly related to the torque transmitted. The torque sensing device may comprise an input drive shaft, subjected in use to the transmitted torque to be monitored, and a further shaft arranged parallel to and to be driven by the said input drive shaft, these two shafts being arranged in a common frame which is mounted for pivoting under the effect of the transmitted torque but is prevented against such pivoting by the action of the compression load cell.

In one arrangement in which the haulage transmission is incorporated in a mining machine and driven by an electric motor which is also arranged to drive at least one mineral working element of the machine, the means responsive to the said electrical signals or the control means responsive to the torque sensing device (as the case may be) may include monitoring means arranged to monitor the total current drawn by the electric motor in use and to decouple the decoupling means when the monitored current reaches a predetermined threshold.

The transmission may comprise a change box providing forward and reverse drives, the decoupling means comprising an input clutch, operative to connect and disconnect drive to the change box selectively, and forward and reverse drive clutches selectively operable to provide a forward and reverse drive through the change box. There may be associated with the input clutch a brake arranged to brake the gear train of the change box whenever the input clutch is disengaged and there may be associated with the forward and reverse drive clutches a further brake arranged to brake the output shaft from the transmission only when neither the forward drive clutch nor the reverse drive clutch is engaged. Conveniently, hydraulic control valves, operated by manual operating means, can be provided to control operation of the input and forward and reverse drive clutches and of the first and second-mentioned brakes. In one arrangement, the manual operating means can be operated to adopt selectively a reset position, in which all the clutches are disengaged, and neutral, forward and reverse positions, in all three of which the input clutch is engaged and in the latter two of which, additionally, the forward and reverse drive clutches, respectively, are engaged.

It is advantageous if the manual operating means includes a logic control unit arranged to maintain the decoupling means decoupled after either the predetermined threshold torque or the predetermined threshold current has been reached, until the manual operating means has been brought into the reset position. The logic control unit can be so arranged that when the power supply to the electric motor is switched on, the decoupling means remains decoupled until the manual operating means has been brought into the reset position. Desirably, the logic control unit is provided with a time delay circuit and is so arranged that unless the manual operating means is brought into the forward or reverse position within a predetermined time, set by the time delay circuit, of having previously been brought into the reset position, the decoupling means is decoupled. The logic control unit can also be so arranged as to detect whether the manual operating means is brought from the forward position to the reverse position (or vice versa) without passing through the reset position and, under such circumstances, is arranged to bring about decoupling of the decoupling means. Suitably, proximity switch means associated with one or more of the positions of the manual operating means are connected to provide the logic control unit with information as to the selected position of the manual operating means.

The logic control unit can be responsive to the state of the said hydraulic control valve which the said control means comprises such that if, in the event of the monitored transmitted torque or the monitored current drawn by the electric motor reaching the predetermined threshold, this hydraulic control valve does not adopt the state necessary to bring about decoupling of the decoupling means, the logic control unit will open switch means, with which the electric motor is provided, to disconnect supply of power to the motor. In a further development, the torque sensing device can include adjustable setting means for loading the compression load cell to produce a given output signal for zero torque transmitted, the logic control unit being arranged to monitor the output signal from the load cell and to decouple the decoupling means in response to the absence of any output signals from the compression load cell.

Figure 2:
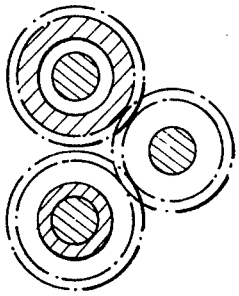
Figure 5:
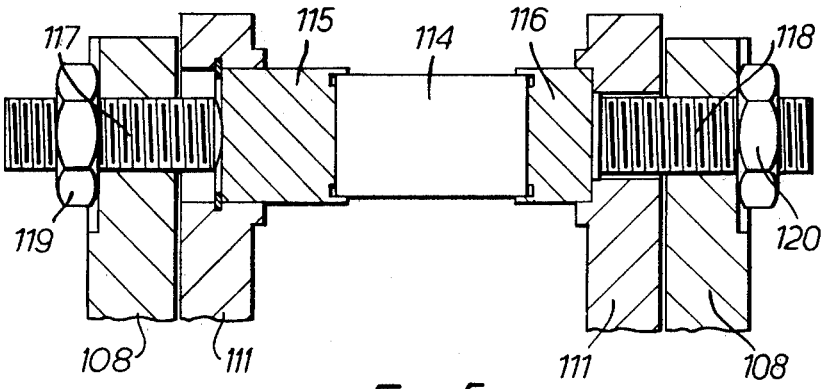
Figure 3:
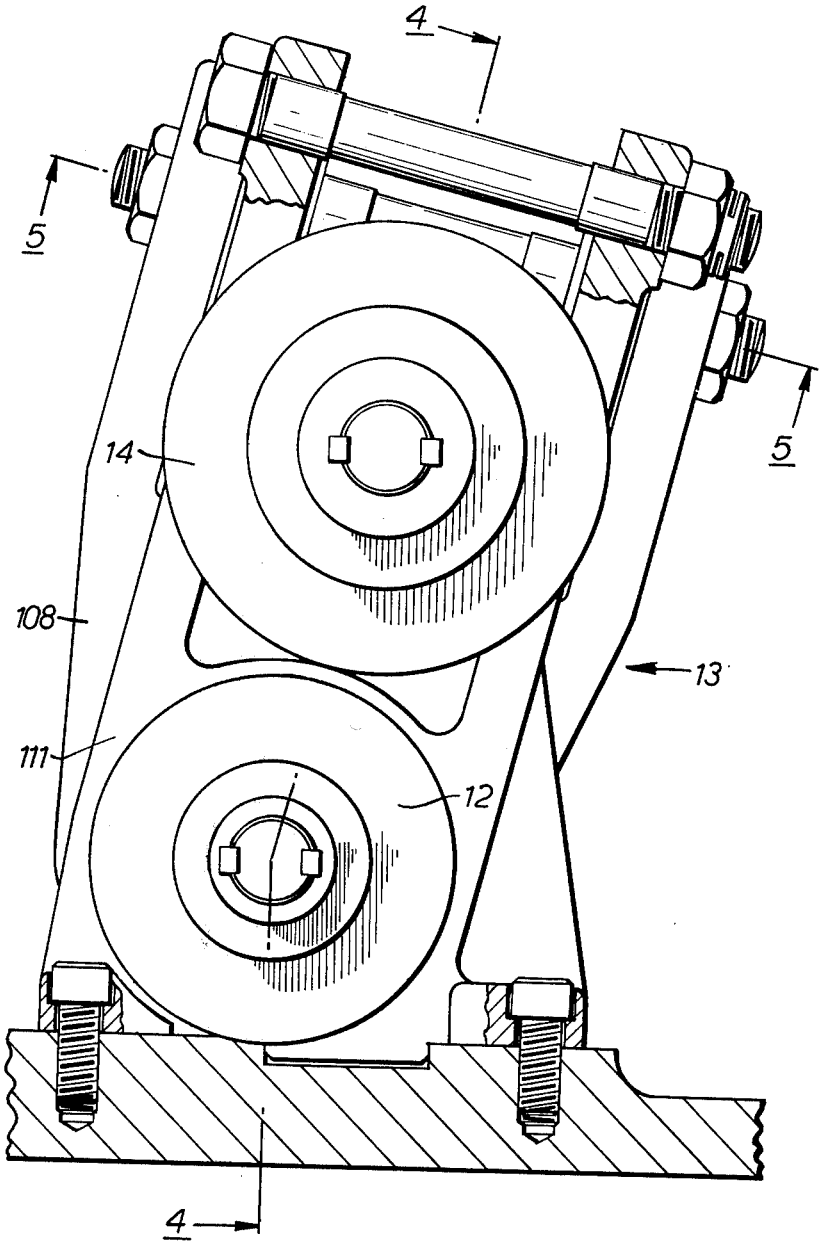
Figure 4:
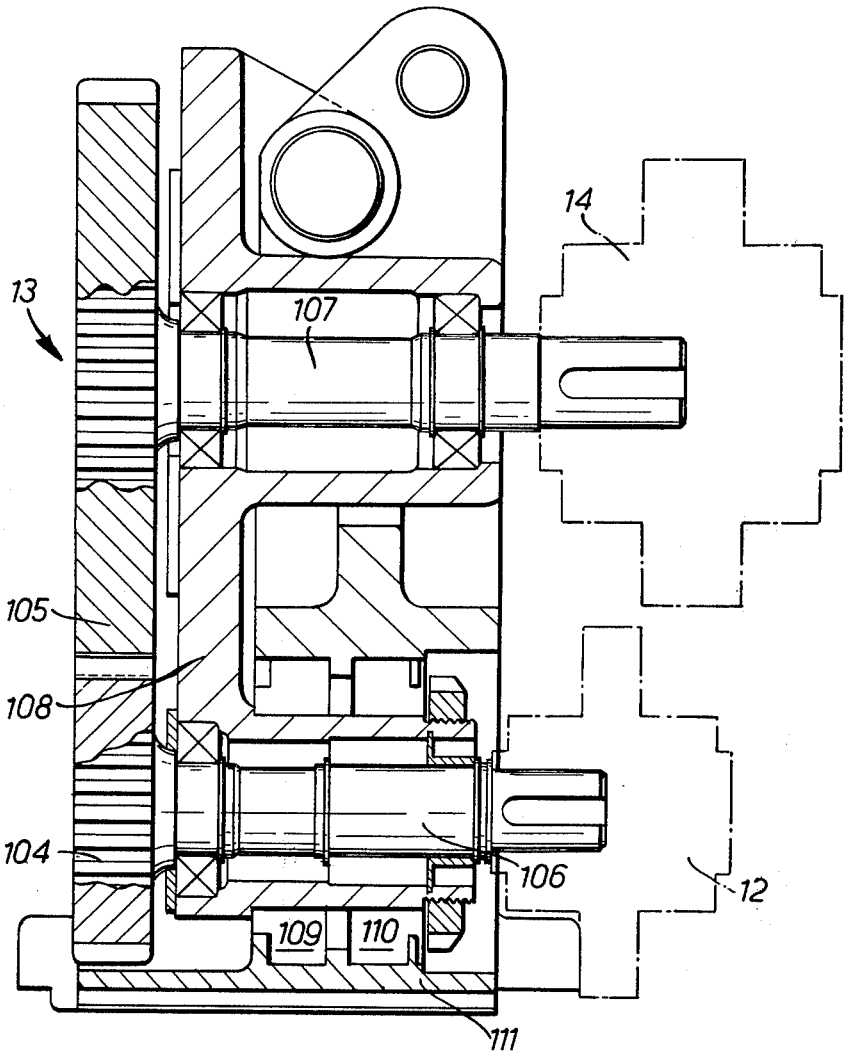
Figure 6:
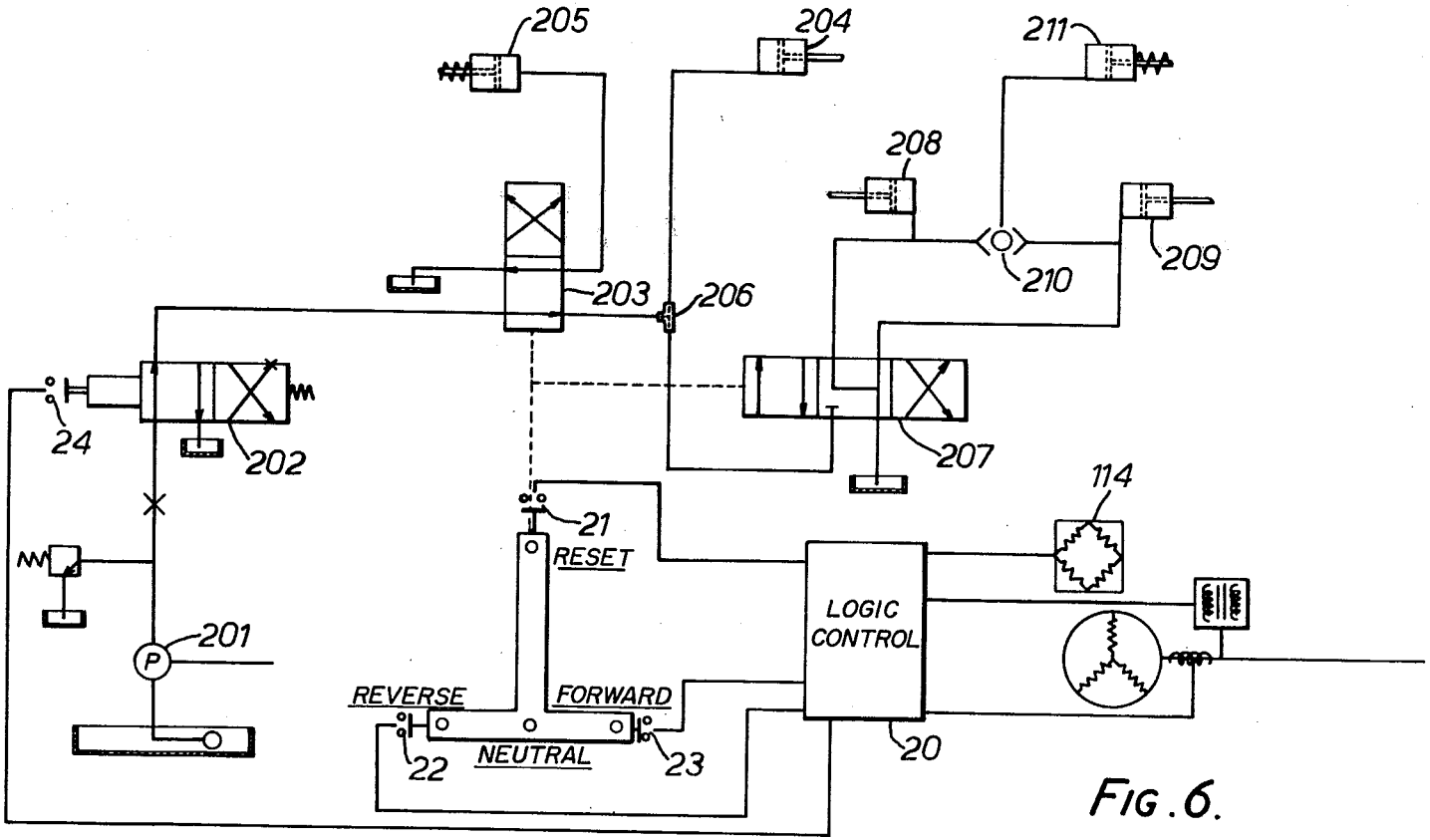

For a better understanding of the invention and to show how the same may be carried into effect, reference will now be made, by way of example, to the accompanying drawings, in which:

FIG. 1 is a plan view of the gear train of a mining machine haulage transmission, FIG. 2 is a part-sectional view taken along the line X—X of FIG. 1, FIG. 3 is a part-sectional, part elevational, end view of a torque sensing device, FIG. 4 is a cross-section through the torque sensing device, taken along the line 4—4 of FIG. 3, FIG. 5 is a part-sectional view taken along the line 5—5 of FIG. 3, and FIG. 6 is a diagrammatic representation of a hydraulic control circuit of the transmission.

Referring to FIG. 1, a power take-off from a prime mover, in this case an electric motor, drives an input shaft 2 of a constant mesh change box 3 via a hydraulically operated input clutch 4, and also a drive shaft 1 coupled to drive a cutting device at one end of the mining machine. Also arranged on input shaft 2 is a spring-loaded disc brake 5 which is also operated by hydraulic pressure, so arranged that when hydraulic pressure is applied to it, the disc brake 5 is "on" and when hydraulic pressure is released from it, the spring load puts it in its "off" position. Hydraulic clutch 4 is also spring loaded and is so arranged that when hydraulic pressure is applied, the clutch is engaged and when hydraulic pressure is released, the clutch is disengaged.

The change box 3 has an output shaft 6 on which are arranged two hydraulically operated forward and reverse drive clutches 7 and 7*a*, similar to hydraulic clutch 4, so arranged that when clutch 7 is engaged, output shaft 6 is driven clockwise, but when clutch 7*a* is engaged, output shaft 6 is driven anti-clockwise, owing to an extra gear then being used in the box 3 to transmit the drive (see FIG. 2). Also arranged on output shaft 6 is a chain sprocket 8 which drives a further chain sprocket 9, which in turn drives a cone braking disc of a cone brake 10. The cone brake 10 is spring loaded and is arranged so that when hydraulic pressure is applied to it, the brake is "off" and when hydraulic pressure is released from it, the brake is "on" under the action of its spring forces.

The drive from the output shaft 6 is transmitted via bevel gears 11, 11*a* through flexible coupling 12 to a torque sensing device 13 and thence via flexible coupling 14 through a fixed ratio reduction gear train to output shaft 15 on which is mounted a haulage sprocket 16.

The haulage transmission operates as follows:

With the electric motor rotating, input clutch 4 is engaged and disc brake is "off", thus driving the change box 3 at the speed pre-selected. One of the output clutches 7 or 7*a* is engaged and the cone brake is "off", thus driving the fixed gear train via the torque sensing device 13, and thereby driving output shaft 15 and its associated haulage sprocket 16.

It is a requirement of the haulage transmission that the torque at the output shaft 15 should be limited to a pre-determined maximum value, regardless of the speed selected in the change box 3. This can be achieved by limiting the torque at the input to the fixed ratio reduction train to a pre-determined maximum value and this is the function of the torque sensing device 13 which will now be described in some detail.

Referring to FIGS. 2 to 4 in particular, the torque sensing device incorporates an input pinion 104 meshing with an output pinion 105, these pinions being respectively mounted on shafts 106 and 107 which in turn are mounted on anti-friction bearings in a frame 108. The frame 108 itself is mounted on anti-friction bearings 109 and 110 within a stationary main frame 111. The input pinion is driven through the flexible coupling 12. A compression load cell 114, which, for a given input voltage, gives an electrical output signal proportional to the compressive load on the cell, is mounted between two locating bobbins 115 and 116 in the frame 108 which are held just in contact with the load cell 114 via adjusting screws 117 and 118 in tapped holes through the main frame 111. The adjusting screws 117 and 118 are locked in position by locknuts 119 and 120.

As the input shaft is rotated, rotation of the frame 108 on the bearings 109, 110 under the action of the transmitted torque is restrained by screws 117 or 118 acting on bobbin 116 or 115 and the load cell 114 is put into compression. The output electrical signal from the load cell is linearly related to the torque transmitted and is fed to a logic control unit 20 (FIG. 6) whose operation is described in detail hereinbelow.

The electrical input to the load cell 114 of the torque sensing device 13 is derived from the supply to the electric motor and the arrangement is such that, when the electrical motor is switched on, a predetermined preload output signal is produced by the load cell 114 when zero torque is being transmitted through the torque sensing device 13. As the torque transmitted through the torque sensing device 13 increases, so does the electrical output which is fed into the logic control unit 20 (FIG. 6) which is situated in the electric motor. When the electric output from the load cell 114 reaches a pre-determined maximum, the logic control unit deenergises a solenoid valve which in turn disengages the hydraulic clutches as will be described hereinbelow with reference to FIG. 6.

Thus the torque transmitted at the output sprocket 16 is limited to a predetermind maximum value.

It is also a requirement of the haulage transmission that it should cease to haul if the total power transmitted by the electric motor exceeds a predetermined maximum value, bearing in mind that this motor not only drives the haulage transmission but also one more cutting devices. The total electric current absorbed by the electric motor is constantly monitored, and when the current exceeds a predetermined maximum value, an electric signal is fed into the logic control unit referred to above which deenergises the solenoid valve already mentioned which in turn disengages the hydraulic clutches as will be described hereinbelow.

In practice, the total power transmitted by the electric motor is a function of the speed at which the coal cutting machine traverses the coal face, i.e. it is a function of the haulage speed. Thus, when the hydraulic clutches are disengaged due to a current overload, it is necessary to select a slower speed of haulage so that the coal cutting machine may continue to traverse the coal face without a current overload condition occurring.

Referring now to FIG. 6 which is a schematic diagram of a hydraulic control circuit for the haulage transmission, a fixed delivery pump 201, driven directly from the electric motor, delivers oil via a solenoid valve 202 to a two-position four-way valve 203. Interposed between the pump 201 and the solenoid valve 202 is a tee piece to a relief valve set at the appropriate operating pressure and a further tee piece to a pressure gauge. The two position valve 203 is operated by a gated master control handle having the four marked positions "reset", "neutral", "forward", and "reverse" and the two positions of valve 203 are "neutral" and "reset".

The four connections to valve 203 are pump inlet, exhaust to tank, a connection to a tee piece 206 and a connection to the single acting spring loaded cylinder (designated 205) of the disc brake 5.

When the valve 203 is in the "neutral" position, the pump inlet is connected to tee piece 206 and the cylinder 205 is connected to tank and the disc brake 5 moves to a non-braking position under the action of its spring.

When the valve 203 is in the "reset" position, the pump inlet is connected to cylinder 205 and the drive brake is moved into a braking position whilst the tee piece 206 is connected to tank. One arm of tee piece 206 is connected to the clylinder 204 of clutch 4 and the other arm is connected to a three position four-way valve 207 which is such as to block the connection from the tee piece 206 when the valve is in its centre position.

The action of moving the master control handle from "neutral" to "reset" alters the condition of the disc brake 5 from "off" to "on" and simultaneously alters the condition of the input clutch 4 from "drive" to "non-drive".

The master control handle which serves to operate the valve 203 also operates the three-position four-way valve 207 the gate of the master control handle is arranged such that the valve 207 cannot be operated whilst the handle is in the "reset" position. The three positions of valve 207 are therefore achieved through the operation of the master control handle into its three positions marked "Forward", "Reverse" and "Neutral".

The four connections to valve 207 are the pump inlet from the tee piece 206, exhaust to tank, a connection to the single-acting spring-loaded cylinder 208 of the forward clutch 7, and a connection to the single-acting spring loaded cylinder 209 of the reverse clutch 7*a*.

Tee pieces in the lines from valve 207 to forward clutch cylinder 208 and reverse clutch cylinder 209 feed into a shuttle valve 210 and thence to cylinder 211 of the spring-loaded hydraulically-operated cone brake 10.

When the master control handle is in "neutral", in addition to the actuation of input clutch 4 and disc brake 5 as already described, both the "forward" and "reverse" clutch cylinders 208, 209 are connected to tank and are both in a non-driving condition. At the same time, the cylinder 211 of cone brake 10 is also connected to tank and the cone brake moves into a braking condition under the action of its spring.

When the master control handle is moved to "forward", in addition to the actuation of input clutch 4 and disc brake 5 as already described, the pump inlet oil from tee piece 206 is connected to the forward clutch cylinder 208 and to the cone brake cylinder 211 via shuttle valve 210. At the same time, reverse clutch cylinder 209 is connected to tank.

That is, moving the master control handle to "forward" ensures that the disc brake 5 is in a non-braking condition, that the input clutch 4 is in a driving condition, that the forward clutch 7 is in a driving condition, that the reverse clutch 7*a* is in a non-driving condition and that the cone brake 10 is in a non-brakifng condition.

Moving the master control handle to "reverse" results in the same operating function except that the reverse clutch 7 drives and the forward clutch does not drive.

It is to be noted that when the solenoid valve 202 is de-energized, all clutches and also the cone brake cylinder 211 are exhausted to tank, thus ensuring that no drive occurs and that the output shaft is braked. This condition occurs whenever solenoid valve 202 is de-energised, regardless of the position of the master control handle. Thus, if for example the master control handle is in the "forward" position and solenoid valve 202 is de-energised, the described condition occurs, even though the control handle remains in its "forward" position.

To re-energize the solenoid valve 202, an electric proximity switch 21 is incorporated, and this switch is operated by the master control handle being moved to its "reset" position. This switch is in connection with the logic circuit unit 20 which is operative to energise the solenoid valve 202 in such manner that when solenoid valve 202 has been de-energised whilst the haulage was driving in either a "forward" or "reverse" direction, output drive can only be re-attained by moving the master control handle from its "forward" (or "reverse") position into the "neutral" position and then into the "reset" position. In this latter position, the electric switch is closed and the solenoid valve re-energised but no output drive can be obtained until the master control handle is moved to "forward" (or "reverse") via "neutral".

It is a further feature of this haulage unit that switching on the electric motor does not in itself result in haulage drive occurring, regardless of the position of the master control handle. This is achieved by the logic control unit 20 which is so arranged that when the electric motor is switched on, solenoid valve 202 remains de-energised until the electric switch 21 is closed by moving the master control handle to its "reset" position. Only after the master control handle has been moved to its "reset" position can haulage drive be attained by selecting "forward" or "reverse".

Another feature is that the control unit is provided with a time delay circuit and a second electrical switching arrangement is utilised such that when the master control handle is moved to either the "forward" or "reverse" position, an electric proximity switch 22 or 23 is closed. The arrangement is such that the switch 22 or 23 must be closed within a predetermined time, e.g. five seconds, of operating the switch 21 or else solenoid valve 202 becomes de-energised. The purpose of this feature is to prevent inadvertent movement of the master control handle from "neutral" to "forward", and thus to prevent unintentional motion of the machine.

An additional requirement of the haulage drive is that it must not be possible to move suddenly from hauling in one direction to hauling in the opposite direction. Moving the master control handle away from the "forward" or "reverse" position opens the switch 22 or 23 and a signal is fed into the logic control unit which de-energises solenoid valve 202. Therefore, a "reset" is required of the master control handle before haulage drive can be re-attained, thus making it impossible to move suddenly from drive "forward" to drive "reverse".

Because of the necessity to limit the torque transmitted by the haulage drive for safety reasons, an additional feature is provided to prevent abuse of the torque control system. The intended operation of the control system could be avoided by physically wedging solenoid valve 202 in a position corresponding to the energised condition so that whilst the control system may be working correctly, the solenoid valve 202 would be prevented from being de-energised and the entire control system would be ineffective. To overcome this, the position of the solenoid valve 202 is monitored by the control unit 20 by means of an electric proximity switch 24, and if the solenoid does not return physically to its de-energised position when a signal requiring it to become de-energised is received in the electric logic control unit, the control unit opens a switch in the power supply circuit of the electric motor.

Normally an output signal from the compressive load cell will always be received by the logic unit since even under a condition of zero torque being transmitted through the load cell, a predetermined pre-load output signal is produced by the cell as mentioned above. However, in order to ensure that the haulage unit will function as intended to de-energise the solenoid valve 202 if the connection between the load cell and the logic control unit is severed in an attempt to run the haulage unit in an overload condition, the control unit 20 can be so arranged as to deenergise the solenoid 202 if no output signal is received from the compressive load cell.

An advantage of the use of the compressive load cell in the torque sensing device is that its construction can be such that the amount by which the cell is compressed, even for large transmitted torques, can be made very small. Moreover, the production of electric, as distinct from hydraulic, signals dependent upon the transmitted torque results in high sensitivity and stability of operation of the overload protection arrangement as disclosed herein. This advantageous operational performance is enhanced by virture of the electric signals which bring about decoupling of the clutches under overload conditions being produced separately from the hydraulic pressure which serves to decouple the clutches.

We claim:

1. A mining machine haulage transmission including an overload protection arrangement comprising a torque sensing device which is aranged to monitor the torque transmitted, in use, by the transmission by producing electrical signals dependent upon the torque transmitted, decoupling means between the input and output of the transmission, and means responsive to the said electrical signals to decouple the decoupling means when the monitored torque reaches a predetermined threshold.

2. A haulage transmission according to claim 1, wherein the signals responsive means comprises drive means connectible to decouple the decoupling means, and control means responsive to the said electric signals to control connection of the drive means to the decoupling means.

3. A haulage transmission according to claim 2, wherein the decoupling means comprise at least one hydraulically operated clutch, the drive means comprising a hydraulic pump arranged to be driven by the transmission input and the control means comprising a hydraulic control valve.

4. A haulage transmission according to claim 1, wherein the torque sensing device is arranged to monitor a reaction force resulting in dependence upon the transmitted torque.

5. A haulage transmission according to claim 4, wherein the torque sensing device comprises a frame which is freely mounted about a pivot axis and which comprises a rotary drive mechanism through which the transmission torque of the haulage transmission is conveyed in use, and further comprises a load sensor restraining the frame against pivotal movement under the effect of the transmitted torque and arranged to provide said electrical signals.

6. A mining machine incorporating a haulage transmission in accordance with claim 1 and an electric motor arranged to drive the transmission and also at least one mineral working element of the machine, the means responsive to the said electrical signals including monitoring means arranged to monitor the total current drawn by the electric motor in use and to decouple the decoupling means when the monitored current reaches a predetermined threshold.

7. A haulage transmission according to claim 1, wherein the transmission further comprises a change box providing forward and reverse drives, the decoupling means comprising an input clutch, operative to connect and disconnect drive to the change box selectively, and forward and reverse drive clutches selectively operable to provide a forward and reverse drive through the change box, there being associated with the input clutch a brake arranged to brake the gear train of the change box whenever the input clutch is disengaged, and there being associated with the forward and reverse drive clutches a further brake arranged to brake the output shaft from the transmission only when neither the forward drive clutch nor the reverse drive clutch is engaged the transmission further comprising manual operating means which can be operated to adopt selectively a reset position, in which all the clutches are disengaged, and neutral, forward and reverse positions, in all three of which the input clutch is engaged and in the latter two of which, additionally, the forward and reverse drive clutches, respectively, are engaged.

8. A haulage transmission according to claim 7, wherein the said manual operating means include means to detect the position of the said manual operating means and a logic control unit responsive to the detecting means so as to prevent the decoupling means from being re-engaged, following decoupling in response to the predetermined threshold torque being reached, unless the manual operating means is brought into the forward or reverse position via the reset position.

9. A mining machine incorporating a haulage transmission in accordance with claim 8 and an electric motor arranged to drive at least the transmission, wherein a logic control unit is provided to sense when the power supply to the electric motor is switched on, in which event the logic control unit prevents the decoupling means from being engaged unless the manual operating means is brought into the forward or reverse position via the reset position.

10. A haulage transmission according to claim 7, wherein the said manual operating means include means to detect the position of the said manual operating means and a logic control unit, provided with a time delay circuit, the logic control unit being responsive to the detecting means so that unless the manual operating means is brought into the forward or reverse positions within a predetermined time, set by the time delay circuit, of having previously been brought into the reset position, the decoupling means will remain decoupled.

11. A haulage transmission according to claim 7, wherein the said manual operating means include means to detect the position of the said manual operating means and a logic control unit responsive to the detecting means so as to bring about decoupling of the decoupling means in the event of the manual operating means being brought from one of the forward and reverse positions into the other such position without passing through the reset position.

12. A mining machine incorporating a haulage transmission in accordance with claim 7 and an electric motor arranged to drive at least the transmission, wherein a logic control unit is arranged to monitor the current drawn by the electric motor and is responsive to the state of a hydraulic control valve, which is arranged to bring about operation of the decoupling means, such that if, in the event of the monitored transmitted torque reaching the predetermined threshold, this hydraulic control valve does not adopt the state necessary to bring about decoupling of the decoupling means, the logic control unit will open switch means, with which the electric motor is provided, to disconnect supply of power to the motor.

13. A haulage transmission according to claim 7, wherein the torque sensing device includes adjustable setting means for loading the compression load cell to produce a given output signal for zero torque transmitted, and a logic control unit is provided to monitor the output signal from the load cell and to bring about decoupling of the decoupling means in response to the absence of any output signals from the compression load cell.

14. A mining machine haulage transmission including an overload protection arrangement comprising a torque sensing device which is arranged to monitor a reaction force resulting in dependence upon the torque transmitted, in use, by the transmission, decoupling means between the input and output of the transmission, drive means connectible to operate the decoupling means, and control means responsive to the torque sensing device to control connection of the drive means to the decoupling means to bring about decoupling of the decoupling means when the monitored transmitted torque reaches a predetermined threshold.

15. A haulage transmission according to claim 14, wherein the decoupling means comprise at least one hydraulically operated clutch, the drive means comprising a hydraulic pump arranged to be driven by the transmission input and the control means comprising a hydraulic control valve.

16. A haulage transmission according to claim 14, wherein the torque sensing device comprises a frame which is freely mounted about a pivot axis and which comprises a rotary drive mechanism through which the transmission torque of the haulage transmission is conveyed in use, and further comprising a load sensor restraining the frame against pivotal movement under the effect of the transmitted torque and arranged to produce electrical output signals, the magnitude of which is linearly related to the torque transmitted, for controlling the control means.

* * * * *